US005127707A

United States Patent [19]

Forcolini

[11] Patent Number: 5,127,707

[45] Date of Patent: Jul. 7, 1992

[54] STRUCTURE FOR A FURNITURE COMPONENT OF UPHOLSTERED AND COVERED TYPE

[75] Inventor: Carlo Forcolini, Milan, Italy

[73] Assignee: Pierluigi Gianfranchi, Milan, Italy; a part interest

[21] Appl. No.: 736,287

[22] Filed: Jul. 25, 1991

[30] Foreign Application Priority Data

Jul. 26, 1990 [IT] Italy ..... 21080 A/90

[51] Int. Cl.[5] ..... A47C 27/00

[52] U.S. Cl. ..... 297/218; 297/219; 297/441; 297/444

[58] Field of Search ..... 297/218, 219, 441, 443, 297/444, 220

[56] References Cited

U.S. PATENT DOCUMENTS

| | | | |
|---|---|---|---|
| 3,659,297 | 5/1972 | Schutz | 297/219 X |
| 3,958,285 | 5/1976 | Gorman . | |
| 4,192,548 | 3/1980 | Williams | 297/218 X |
| 4,284,305 | 8/1981 | Porter | 297/218 X |
| 4,408,797 | 10/1983 | Franck et al. | 297/218 |
| 4,488,755 | 12/1984 | Nemschoff | 297/444 X |
| 5,015,034 | 5/1991 | Kindig et al. | 297/218 X |

FOREIGN PATENT DOCUMENTS

| | | | |
|---|---|---|---|
| 530270 | 7/1954 | Belgium | 297/444 |
| A3104616 | 8/1982 | Fed. Rep. of Germany . | |
| U8607672 | 9/1987 | Fed. Rep. of Germany . | |
| A2580562 | 10/1986 | France . | |
| A112729 | 8/1986 | Netherlands . | |
| 407518 | 3/1934 | United Kingdom | 297/441 |
| A88705480 | 9/1987 | World Int. Prop. O. . | |

*Primary Examiner*—Laurie K. Cranmer
*Attorney, Agent, or Firm*—Ladas & Parry

[57] ABSTRACT

A structure for a furniture component of upholstered and covered type, characterized by consisting of at least one part (5) comprising an inner rigid panel (7) provided on its perimetral edges with a channel (8) of given cross-section which houses by forced insertion a strip element (9) of cross-section complementary to said given cross-section, on the outer face of said rigid panel there being applied a layer of expanded material (10) or the like forming the actual upholstery, the covering fabric (11) consisting of a flat piece with a surface equal in size to the surface of the expanded material plus a peripheral edge which can be folded about the peripheral edges of said expanded material and over said channel (8).

4 Claims, 2 Drawing Sheets

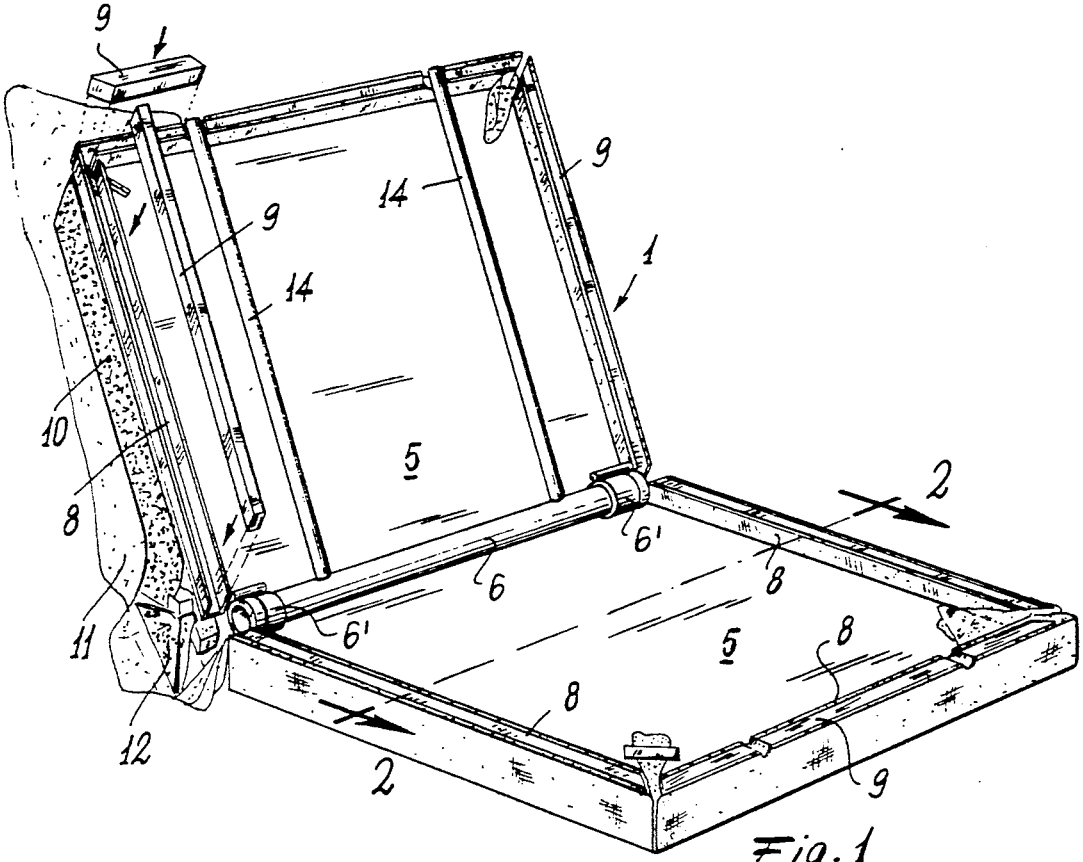
Fig. 1
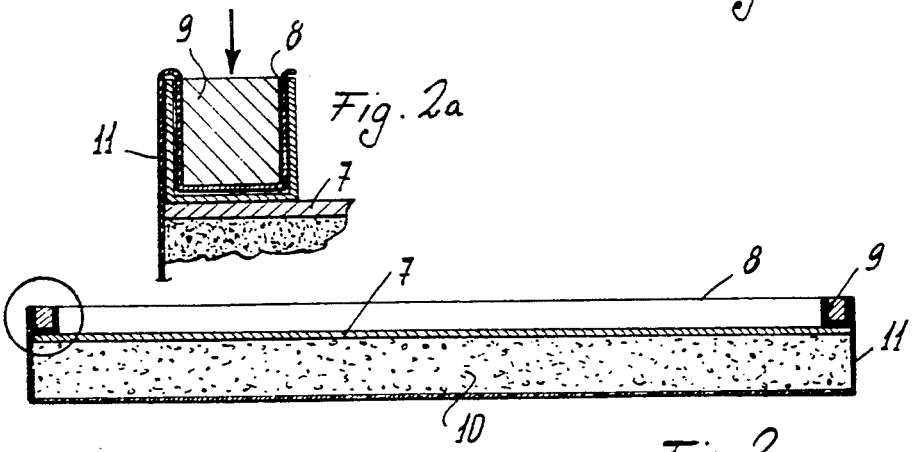
Fig. 2a
Fig. 2

STRUCTURE FOR A FURNITURE COMPONENT OF UPHOLSTERED AND COVERED TYPE

This invention relates to a structure for a furniture component of upholstered and covered type.

In the present context the term "furniture component" means any component which can be combined with other components to form a complete article of furniture.

Typical of the many such components are the arm rests and back rests of armchairs or sofas, the headboards of beds and generally all those components which for their assembly require mounting on a base frame.

There are three main types of upholstered furniture (sofas, armchairs, chairs, bed etc.), namely:

a) upholstered furniture with fixed covering which cannot be removed;

b) upholstered furniture with shaped covering (for example of a sofa) which can be removed and washed, but requiring the services of an upholsterer or re-covering in the manufacturer's factory;

c) upholstered furniture with unshaped covering in sheet form, for example for randomly covering a sofa.

Type b) is the most common, but from the production viewpoint this type involves cutting, shaping and sewing operations which on average account for 30% of the labour cost in covering upholstered furniture.

In addition, the replacement of old covering by new covering can sometimes present difficulties due to the possible state of wear of the original upholstering, which will not have been considered in the cost of the new covering and requiring for its repair the services of an upholsterer, the cost of which must be added to the purchase price of the new covering.

An object of the present invention is to provide a structure for a furniture component of upholstered and covered type which is conceived in such a manner as to result in a considerable reduction in labour costs.

A further object of the invention is to provide a structure for a furniture component, the covering of which can be very easily replaced by the purchaser himself.

A further object is to provide this structure at low production cost such as to result in a highly competitive final price to the public.

These and further objects of the invention are attained as will be apparent to the expert of the art on reading the following description and claims.

The structure for a furniture component of upholstered and covered type according to the invention is characterised by consisting of at least one part comprising an inner rigid panel provided on its perimetral edges with a channel of a given cross-section which houses by forced insertion a strip element of cross-section complementary to said given cross-section, on the outer face of said rigid panel there being applied a layer of expanded material or the like forming the actual upholstery, the covering fabric consisting of a flat piece with a surface equal in size to the surface of the expanded material plus a peripheral edge which can be folded about the peripheral edges of said expanded material and over said channel.

The structure for a furniture component is represented in the accompanying figures, which show by way of example an armchair component, and in which:

FIG. 1 is a perspective view of the component in the open position;

FIG. 2 is a section on the line II—II of FIG. 1;

Figure 3:
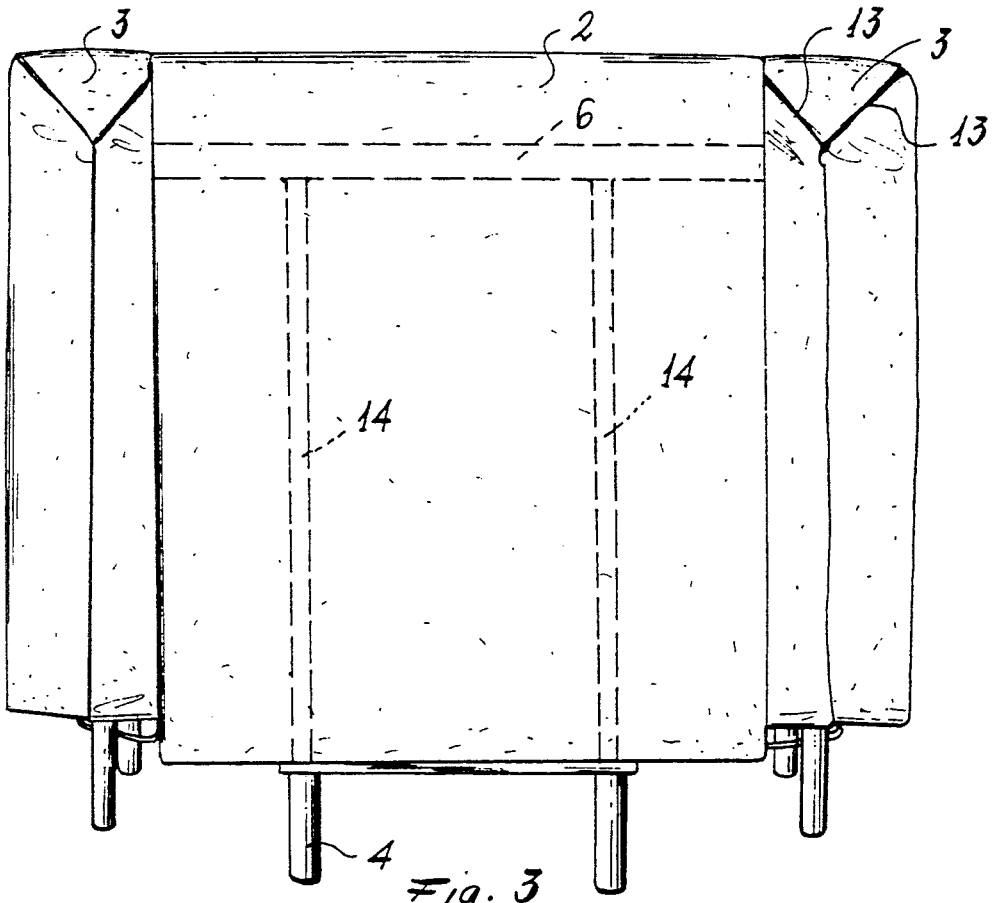
Figure 4:
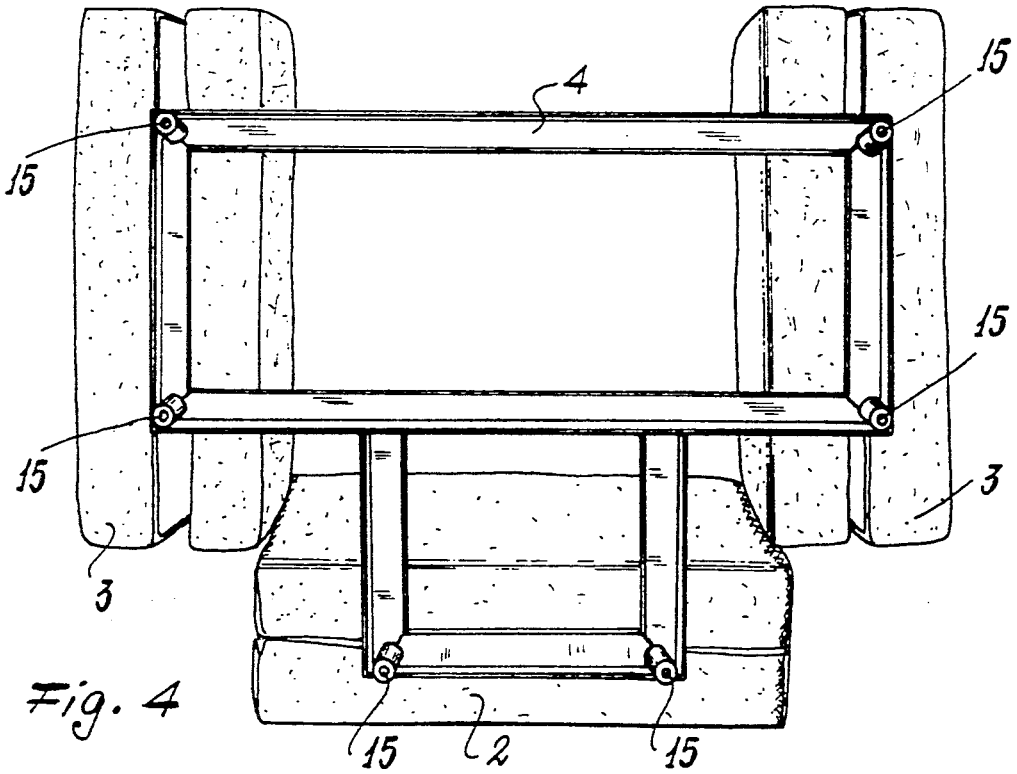

FIG. 2*a* is a magnified view of the left top corner of the sectional view of FIG. 2;

FIG. 3 is a rear view of an armchair formed with components having the structure of the invention; and FIG. 4 is a view from below of the armchair of FIG. 3.

With reference to said figures, the component, indicated overall by 1, represents the back rest 2 of an armchair, the arm rests 3 of which also have the structure of the invention. The back rest 2 and arm rests 3 are mounted on a conventional metal base frame 4 as described hereinafter.

As the component 1 is part of an armchair, this component must be covered on both its opposing faces. However, if the component 1 is to form for example the headboard of a bed, the covering will appear only on the exposed face.

With reference to FIGS. 1 and 2, the component 1 consists of two parts 5, 5 which are hinged together at 6' by a bar 6.

Each part 5 is substantially of quandrangular form and consists of an inner rigid panel 7 provided on its three free edges (the fourth edge houses the bar 6) with a channel 8 of square cross-section housing an inserted strip element 9 of complementary square cross-section.

On the outer face of the panel 7 there is glued a layer of expanded material 10 forming the actual upholstery.

In the case shown in FIG. 1, to cover the component 1 it is sufficient to use a piece of flat fabric (i.e. without sewn portions) having a surface equal in size to the surface of the expanded material 10 plus a peripheral edge such as to enable it to be folded about the peripheral edges of said expanded material and over the channels 8. The measurements must be taken with both the pieces 5 complement open and extended.

To fix the fabric 11, its edges are positioned over the channels 8, and the strip elements 9 are then forced into the channels over said edges to lock them in position.

In order to give the upholstery 10 a definite shape (square in the example) at the bar 6, the upholstery can comprise inserts 12 of greater rigidity, to form a fissure 13 (FIG. 3) into which the fabric can be forced using a blade-like implement.

The component 1 is fixed to the frame 4 by screwing the end parts of rods 14 into those points of the frame 4 indicated by 15 in FIG. 4.

The fixing system using the bar 6 and rods 14 is used in the case of a component 1 with a double covered face, but any desired fixing system can be used if the component consists of a single part 5, and hence covered on only one face, as in the case of a bed headboard.

From the aforegoing it is apparent that the proposed structure enables a furniture component of the upholstered and covered type to be formed which satisfies the objects stated in the introduction to the present description in a rational and convenient manner.

I claim:

1. A structure for a furniture component of upholstered and covered type, comprising:

two hingedly connected components each having an outer and an inner face, said inner faces facing each other when said two components are brought into mutual contact;

channel means on said inner faces adjacent the periphery thereof;

hinge means comprising a bar along one edge of each component;

rods connected to said bar and extending perpendicularly thereto;

a layer of expanded material on the outer faces of said components;

a covering fabric for covering said layer of expanded material;

strip elements locatable in said channel means for fixing said covering fabric between said strip elements and the interior of said channel means;

and a frame for supporting said two components by attachment thereto of said rods.

2. A structure for a furniture component as claimed in claim 1 for use as a back rest of an armchair.

3. A structure for a furniture component as claimed in claim 2, wherein said layer of expanded material comprises rigid inserts positioned adjacent said hinge means, to form fissures into which said covering fabric is forced.

4. A structure for a furniture component as claimed in claim 1 for use as an arm rest of an armchair.

* * * * *